US008419175B2

(12) United States Patent
Graham et al.

(10) Patent No.: US 8,419,175 B2
(45) Date of Patent: Apr. 16, 2013

(54) PRINTING SYSTEM INCLUDING FILTER WITH UNIFORM PORES

(75) Inventors: Jason J. Graham, Centerville, OH (US); James E. Harrison, Jr., New Lebanon, OH (US); Lawrence A. Wellner, Waynesville, OH (US)

(73) Assignee: Eastman Kodak Company, Rochester, NY (US)

( * ) Notice: Subject to any disclaimer, the term of this patent is extended or adjusted under 35 U.S.C. 154(b) by 1 day.

(21) Appl. No.: 13/213,143

(22) Filed: Aug. 19, 2011

(65) Prior Publication Data

US 2013/0044166 A1 Feb. 21, 2013

(51) Int. Cl.
*B41J 2/175* (2006.01)

(52) U.S. Cl.
USPC ..... 347/93

(58) Field of Classification Search ..... 347/71, 347/89, 90, 92, 93
See application file for complete search history.

(56) References Cited

U.S. PATENT DOCUMENTS

| | | | | |
|---|---|---|---|---|
| 4,636,808 | A | 1/1987 | Herron | |
| 6,079,821 | A | 6/2000 | Chwalek et al. | |
| 6,350,361 | B1 | 2/2002 | Sexton et al. | |
| 6,457,807 | B1 | 10/2002 | Hawkins et al. | |
| 6,491,362 | B1 | 12/2002 | Jeanmaire | |
| 6,505,921 | B2 | 1/2003 | Chwalek et al. | |
| 6,554,410 | B2 | 4/2003 | Jeanmaire et al. | |
| 6,575,566 | B1 | 6/2003 | Jeanmaire et al. | |
| 6,588,888 | B2 | 7/2003 | Jeanmaire et al. | |
| 6,793,328 | B2 | 9/2004 | Jeanmaire | |
| 6,827,429 | B2 | 12/2004 | Jeanmaire et al. | |
| 6,851,796 | B2 | 2/2005 | Jeanmaire et al. | |
| 7,111,932 | B2 * | 9/2006 | Steed et al. | 347/92 |
| 7,901,064 | B2 * | 3/2011 | Urayama et al. | 347/93 |
| 7,938,522 | B2 * | 5/2011 | Xie et al. | 347/90 |
| 2007/0291082 | A1 | 12/2007 | Baumer et al. | |
| 2008/0259146 | A1 * | 10/2008 | Suzuki | 347/93 |
| 2009/0135223 | A1 | 5/2009 | Xie et al. | |
| 2009/0195612 | A1 | 8/2009 | Xie et al. | |
| 2010/0295912 | A1 * | 11/2010 | Xie et al. | 347/90 |
| 2010/0328407 | A1 | 12/2010 | Xie et al. | |

* cited by examiner

*Primary Examiner* — Kristal Feggins
(74) *Attorney, Agent, or Firm* — William R. Zummerli

(57) ABSTRACT

A printing system includes a filter, a printhead including nozzles through which liquid is emitted, and a liquid supply system in liquid communication with the printhead through the filter. The filter, an electroformed metal structure, includes a plurality of first recesses, a plurality of second recesses, a plurality of first pores, and a plurality of second pores. Each of the plurality of first recesses includes a first recess diameter and a first recess center-to-center spacing relative to each other. Each of the plurality of second recesses includes a second recess diameter and a second recess center-to-center spacing relative to each other. Each of the plurality of first pores is in fluid communication with a corresponding one of the plurality of first recesses and each of the plurality of second pores is in fluid communication with a corresponding one of the plurality of second recesses. In the filter, the first recess diameter is not equal to the second recess diameter and the first recess center-to-center spacing is not equal to the second recess center-to-center spacing.

14 Claims, 10 Drawing Sheets

PRINTING SYSTEM INCLUDING FILTER WITH UNIFORM PORES

CROSS REFERENCE TO RELATED APPLICATIONS

Reference is made to commonly-assigned, U.S. patent application Ser. No. 13/213,141, entitled "MANDREL FOR ELECTROFORM FILTER INCLUDING UNIFORM PORES", Ser. No. 13/213,133, entitled "ELECTROFORM FILTER STRUCTURE INCLUDING UNIFORM PORE SIZE", all filed concurrently herewith.

FIELD OF THE INVENTION

This invention relates generally to electroformed metal structures, and in particular to electroformed metal filter structures that are included in printing systems and have a uniform pore size.

BACKGROUND OF THE INVENTION

The use of inkjet printers for printing information on recording media is well established. Example printers employed for this purpose include continuous printing systems which emit a continuous stream of drops from which specific drops are selected for printing in accordance with print data. Other printers include drop-on-demand printing systems that selectively form and emit printing drops only when specifically required by print data information.

Printing systems that combine aspects of drop-on-demand printing and continuous printing are also known. In these types of printing systems, liquid is continuous circulated through the printing systems but only printing drops are emitted from the printing system when specifically required by print data information. These systems, often referred to as flow through liquid drop dispensers or continuous on demand printing systems, provide increased drop ejection frequency when compared to drop-on-demand printing systems without the complexity of continuous printing systems.

These printing systems include a liquid supply system and a printhead(s) that includes a plurality of nozzles fed by the liquid supply system. Particulate contamination in the liquid, for example, ink ejected from each printing system can adversely affect quality and performance because, for example, the printheads have small diameter nozzles. As such, these types of printing systems typically include one or more filters positioned at various locations in the liquid path to reduce problems associated with particulate contamination.

If, for example, contaminants of diameter D or larger can clog a nozzle or cause the jet emitted from a nozzle to be misdirected, the filter that removes these contaminants should have pores with diameters less than D. As ink passes through the pores of a filter the pressure drop across the filter depends on the diameter of the pores. It is therefore desirable for filters to have pores as large as possible while still filtering out the problem causing contaminants. It is also desirable for the filter to have as many pores as possible, to reduce the pressure drop across the filter.

Many different techniques and combinations of materials have been used for making filters with sufficiently small diameter holes as to capture particulate contamination as small as 4 microns. Punching, laser drilling, molding, and machining are known techniques, however, electroforming is generally considered an effective technique for making articles, such as filters, requiring fine geometric features. One reason for this is because electroformed filters have been found to shed less particulate matter when compared to filters made using the other techniques described above.

The electroforming process, also called an electroplating process, uses an electric current to transfer metal ions from a source metal (for example, nickel) to a conductive object. The source metal and the conductive object are immersed in an electrolyte solution that permits current flow from the source metal to the conductive object. As the current flows, metal ions from the source metal are deposited onto the conductive object to form a metal layer. The deposition rate of the source metal is directly related to the current, with a higher current yielding a higher deposition rate.

In order to form geometric features, such as filter pores, in the plated metal layer, portions of the conductive object are masked by a non-conductive material to prevent metal from being plated onto these regions. When making orifices or filter pores, it is common to plate a metal layer on the conductive object that is sufficiently thick that the plated metal layer overplates a portion of the non-conductive material. As a result, the size of the pore or opening through the metal layer depends on the thickness of the plated metal layer. The thickness of the plated metal layer depends in part on the current density. The current density, which is the current across the surface area of the article being formed, can vary, especially in areas with geometric features. The current density of the ends of the article can differ from the current density in the middle of the part. This can produce electroforming filters with an unacceptably large variation in filter pore diameters.

Therefore, there is an ongoing need for an electroformed filter having a uniform pore diameter that is suitable for use in any of the printing systems described above.

SUMMARY OF THE INVENTION

According to one aspect of the invention, a printing system includes a filter, a printhead including a plurality of nozzles through which liquid is emitted, and a liquid supply system in liquid communication with the printhead through the filter. The filter is an electroformed metal structure and includes a plurality of first recesses, a plurality of second recesses, a plurality of first pores, and a plurality of second pores. Each of the plurality of first recesses includes a first recess diameter and a first recess center-to-center spacing relative to each other. Each of the plurality of second recesses includes a second recess diameter and a second recess center-to-center spacing relative to each other. Each of the plurality of first pores is in fluid communication with a corresponding one of the plurality of first recesses and each of the plurality of second pores is in fluid communication with a corresponding one of the plurality of second recesses. In the filter, the first recess diameter is not equal to the second recess diameter and the first recess center-to-center spacing is not equal to the second recess center-to-center spacing.

According to another aspect of the invention, a method of printing includes providing a filter, a printhead including a plurality of nozzles through which liquid is emitted, and a liquid supply system that is in liquid communication with the printhead through the filter. The filter is an electroformed metal structure and includes a plurality of first recesses, a plurality of second recesses, a plurality of first pores, and a plurality of second pores. Each of the plurality of first recesses includes a first recess diameter and a first recess center-to-center spacing relative to each other. Each of the plurality of second recesses includes a second recess diameter and a second recess center-to-center spacing relative to each other. Each of the plurality of first pores is in fluid communication with a corresponding one of the plurality of first recesses and each of the plurality of second pores is in fluid communication with a corresponding one of the plurality of second recesses. In the filter, the first recess diameter is not equal to the second recess diameter and the first recess center-to-center spacing is not equal to the second recess center-to-center spacing. Liquid is caused to be emitted through the plurality of nozzles of the printhead.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
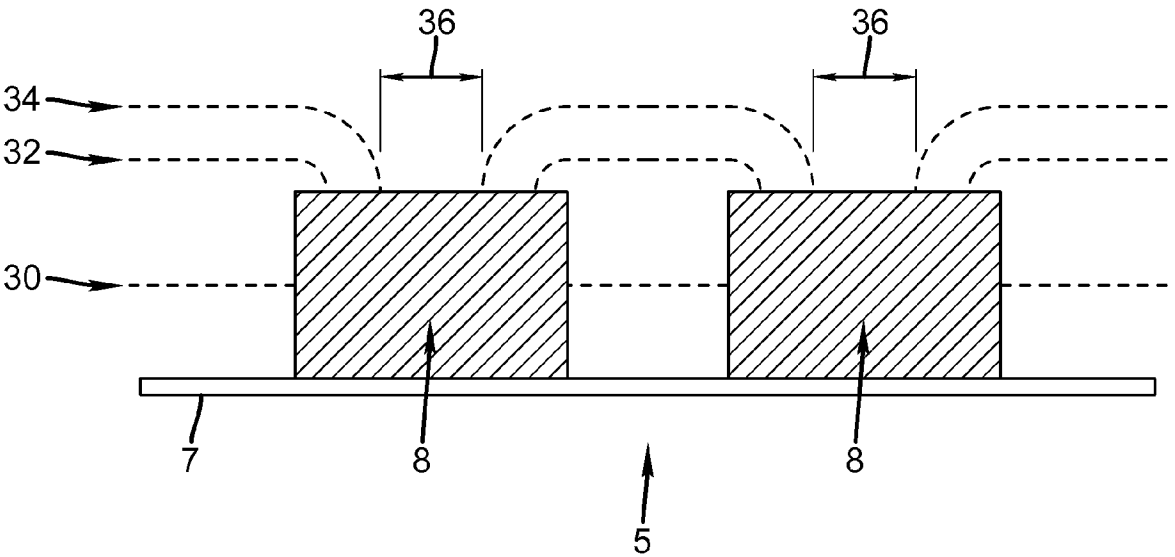
FIG. 1 is a is a cross section showing the deposition of a source metal around photoresist pegs, at various stages of an electroforming process.

The present description will be directed in particular to elements forming part of, or cooperating more directly with, an apparatus in accordance with the present invention. It is to be understood that elements not specifically shown, labeled, or described may take various forms well known to those skilled in the art. In the following description and drawings, identical reference numerals have been used, where possible, to designate identical elements. It is to be understood that elements and components may be referred to in singular or plural form, as appropriate, without limiting the scope of the present invention.

The example embodiments of the present invention are illustrated schematically and not to scale for the sake of clarity. One of ordinary skill in the art will be able to readily determine the specific size and interconnections of the elements of the example embodiments of the present invention.

Electroforming is generally known as an effective manufacturing technique for producing complex metal structures with tolerances as low as one micron. The electroforming process involves plating a metalized layer onto a conductive substrate, which is subsequently removed, leaving the metal structure. When the metal structure to be electroformed includes openings, such as pores or holes, portions of the conductive substrate are masked off with non-conductive geometric features. The metalized layer is plated onto the conductive substrate around the masked portions, but isn't plated on the masked portions. The conductive substrate along with the non-conductive geometric features is generally known as a mandrel.

During the electroforming process, the mandrel and a source metal (for example nickel or copper) are immersed in an electrolyte solution, also called a plating solution. The source metal is positively charged relative to the mandrel with the source metal serving as the anode and the mandrel serving as the cathode. The electrolyte is conductive and as current flows through the electrolyte from the anode to the cathode metal ions from the source metal are transported through the electrolyte solution and are deposited onto the mandrel. Generally, the deposition rate of the source metal is directly related to the current with a higher current yielding a higher deposition rate. After the metalized layer has formed the metal structure with the desired dimensions, the mandrel and the metal structure are removed from the plating solution and the metal structure is separated from the mandrel.

FIG. 1 depicts the electroforming process where the resulting metal structure is to include openings 36. The mandrel 5 includes a conductive layer 7 with photoresist pegs 8 which are non-conductive. At an initial plating thickness 30, the metalized layer 38 forms by electroplating onto the conductive layer 7 around the photoresist pegs 8. In this initial stage, the metalized layer thickness 30 (represented by dashed line 30) is less than the height of the photoresist pegs 8. As the electroforming process continues, the thickness of the metalized layer 38 increases, ultimately exceeding the thickness of the photoresist pegs 8 at an intermediate plating thickness 32 (represented by dashed line 32). Continued plating after the intermediate plating thickness 32 causes the metalized layer to begin to plate over the tops of the photoresist pegs 8, exposing additional conductive surface area. The additional conductive surface area causes the source metal to plate not only upwardly, increasing thickness, but also in a radial direction across the tops of the photoresist pegs 8. As the source metal continues to plate in the radial direction, openings 36 form above the photoresist pegs 8 and begin to reduce in size. Plating is stopped at a final plating thickness 34 (represented by dashed line 34), where the metalized layer 38 has been plated to sufficient thickness to produce openings 36 having a desired diameter. The metalized layer 38 is then separated from the mandrel 5.

As discussed above, the deposition rate of the source metal is dependent on the current flowing through the electrolyte solution to the exposed conductive surface area of the mandrel 5. Any variation in current density across the mandrel 5 can affect the rate in which the thickness of the metalized layer increases and can therefore affect the size of the openings 36. As such, any variation in current density across the mandrel 5 can result in the metal structure having openings 36 of varying diameters.

It has been found that the deposition rate is higher in the middle portion of the mandrel 5 when compared to areas near the ends or outer portions 10 of the mandrel 5, causing the thickness of the metalized layer to increase more quickly in the middle than near the ends. When the individual segments 78 of the mandrel 5 that correspond to the individual filters to be electroformed (see FIG. 6) span a considerable portion of the mandrel 5 in at least one direction, this leads to a non-uniform current density across the length of the filter segments 78, with a higher current density in the middle of mandrel 5 when compared to areas near the ends of mandrel 5. The resulting electroformed filters 6 therefore can have openings 36 that are smaller in some areas than in other areas.

Additionally, it has been found that when a large portion of the conductive layer 7 is covered by photoresist pegs 8, it is difficult to achieve uniform thickness of the metalized layer, and accordingly uniform openings 36. In particular, where the ratio of the surface area covered by the non-conductive pegs to the surface area of the conductive layer not covered by the photoresist pegs is two to one or greater, it is particularly difficult to achieve uniformity.

Figure 2:
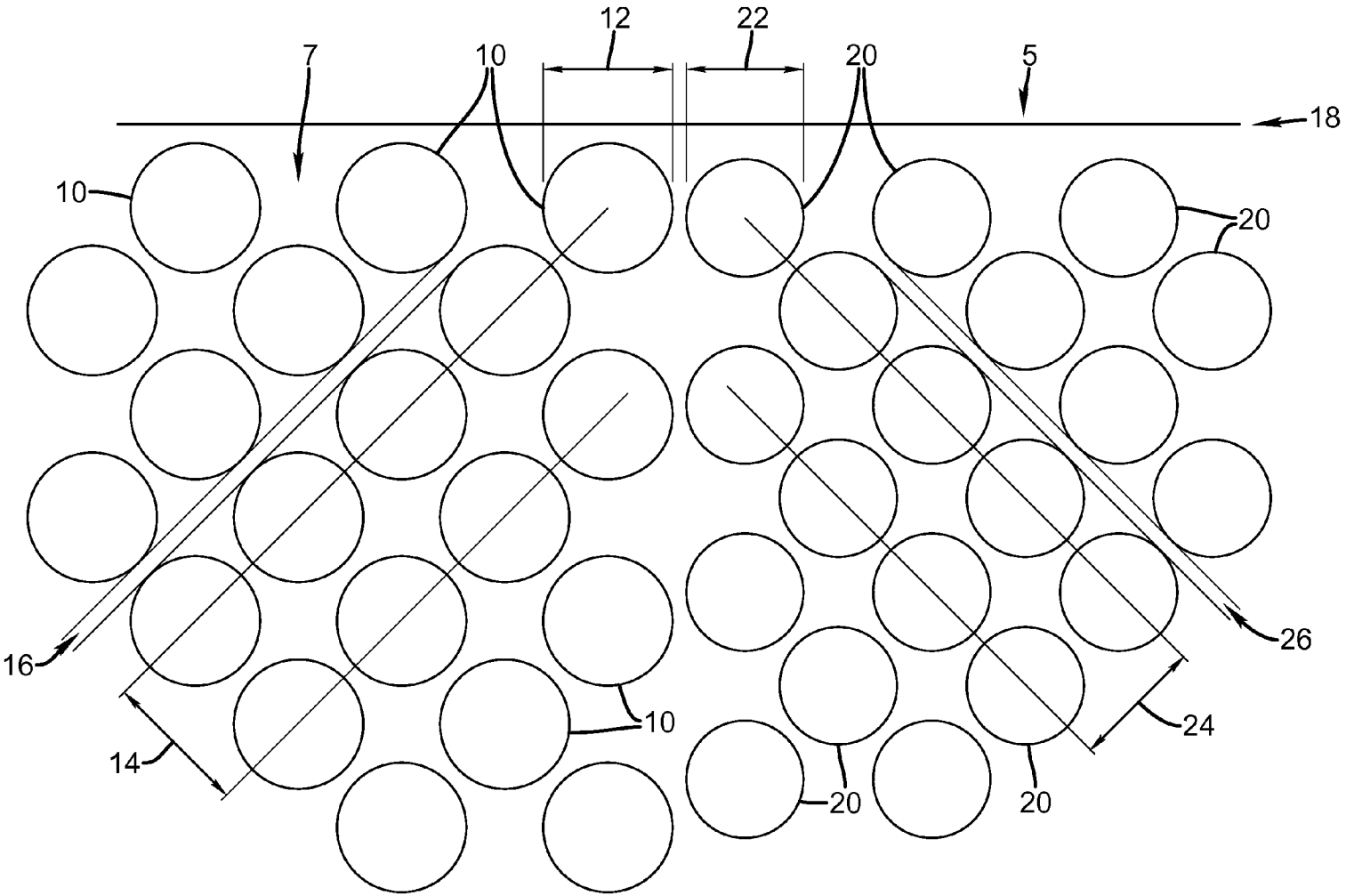
FIG. 2 is a plan view of a portion of a mandrel, for electroforming a filter according to an embodiment of the invention, having a plurality of first photoresist pegs and a plurality of second photoresist pegs.

Referring to FIG. 2, a portion of the mandrel 5 is shown, where the resulting metal structure is a filter, according to one example embodiment of the invention. The mandrel 5 has a conductive layer 7 that includes a highly conductive material to limit the voltage drop across the conductive layer 7. A current drop across the conductive layer can also lead to a variation in deposition rate across the mandrel, and therefore should be kept to low. To facilitate removal of the mandrel from the filter once the electroforming is complete, the conductive layer 7 is treated with a parting film, or an oxide as to make the surface passive. This provides for a low adhesion between the mandrel 5 and the filter 30 that the filter can be can be peeled away from the mandrel 5, allowing the mandrel 5 to be reused. Suitable materials for the conductive layer 7 include, but are not limited to, chromium, molybdenum, titanium, tungsten, aluminum, steel, alloys thereof, and combinations thereof.

The conductive layer 7 is coated with non-conductive photoresist, which is then exposed through a photomask and developed to form a plurality of first photoresist pegs 10 and a plurality of second photoresist pegs 20. Each of the first photoresist pegs 10 has a first diameter 12, and is arranged in a staggered formation with a first center-to-center spacing 14 and a first edge-to-edge spacing 16. Each of the second photoresist pegs 20 has a second diameter 22, and is arranged in a staggered formation with a second center-to-center spacing 24 and a second edge-to-edge spacing 26.

Generally, the first edge-to-edge spacing 16 is approximately equivalent to the second edge-to-edge spacing 26. However, the first center-to-center spacing 14 and the first diameter 12 are generally larger than the second center-to-center spacing 24 and the second diameter 22, respectively. As used herein, the term approximately equivalent refers to the dimensions that are typically obtained when using an electroforming process. These dimensions may even approach 1 micron depending on the application contemplated. Generally, the plurality of first photoresist pegs 10 is located in areas of higher anticipated current density (an example of a first area of the conductive material layer 7 of mandrel 5) and the plurality of second photoresist pegs 20 is located in areas of lower anticipated current density (an example of a second area of conductive material layer 7 of mandrel 5).

The geometric arrangements of the pluralities of first and second photoresist pegs 10, 20 serve to compensate the variation in deposition rate across the mandrel 5. It has been found that decreasing only the second diameter 22 of the second photoresist pegs 20 so as to require less radial direction plating is not effective in obtaining uniform radial direction plating. Decreasing the second diameter 22 while leaving the second center-to-center spacing 24 the same, increases the conductive surface area within the plurality of second photoresist pegs 20. It is thought that this increased conductive surface area introduces a robber effect, which draws current and source metal away from radial direction plating over the tops of the plurality of second photoresist pegs 20. This effect is most significant when the photoresist peg diameter is large relative to the peg edge-to-edge spacing; large being greater than a factor of 10 times the peg edge-to-edge spacing 16.

In order to fully compensate for the varying current density across the mandrel 5 (especially when electroforming filters in which the first recess diameter is large relative to the recess edge-to-edge spacing, for example, being greater than a factor of 10 times) along with reducing the second diameter 22, the second center-to-center-spacing 24 is reduced such that the second edge-to-edge spacing 26 is approximately equivalent to the first edge-to-edge spacing 16. By changing both the second diameter 22 and the second center-to-center spacing 24, the exposed conductive area within the plurality of second photoresist pegs 20 remains at a consistent non-conductive to conductive ratio.

Figure 3:
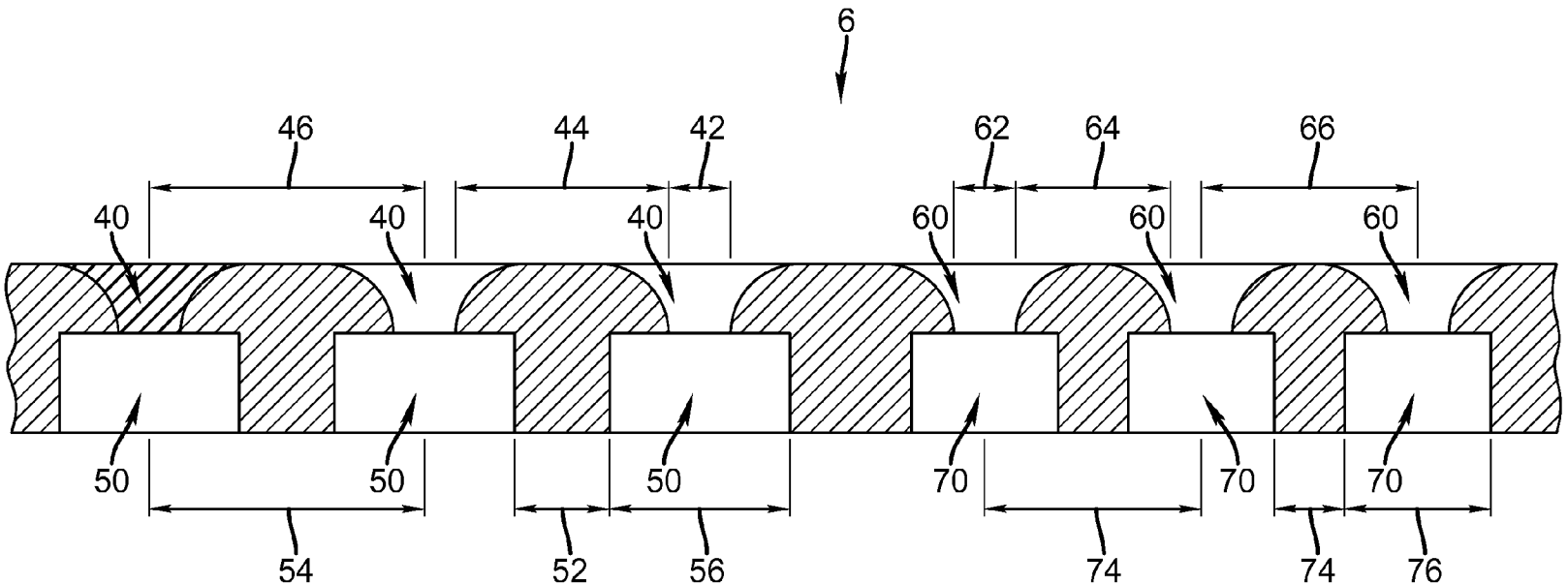
FIG. 3 is a cross section of a portion of an embodiment of a filter produced by the electroforming process after the mandrel has been removed.

Referring to FIG. 3, a cross section of a portion of the filter 6 after the mandrel 5 and the filter 6 have been separated is shown. There are a plurality of first recesses 50 and a plurality of second recesses 70. Each of the first recesses 50 has a first recess diameter 56, a first recess center-to-center spacing 54, and a first recess edge-to-edge spacing 52. Similarly, each of the second recesses 70 has a second recess diameter 76, a second recess center-to-center spacing 74, and a second recess edge-to-edge spacing 72. Generally, the geometries of the pluralities of first and second recesses 50, 70 correspond to the pluralities of first and second photoresist pegs 10, 20.

During the electroforming process, the radial direction plating across the tops of the pluralities of first and second photoresist pegs 10, 20 forms a plurality of first pores 40 and a plurality of second pores 60. Each of the first pores 40, as created from the metalized layer at the final plating thickness 34, has a first pore diameter 42, a first pore edge-to-edge spacing 44 and a first pore center-to-center spacing 46. Each of the second pores 60 has a second pore diameter 62, a second pore edge-to-edge spacing 64 and a second pore center-to-center spacing 66 and each of the plurality of second pores having a second pore diameter 62. While the variation in current density across the mandrel 5 remains, less source metal is required to reach the desired second pore diameter 62, therefore, the first and second pore diameters 42, 62 are approximately equivalent. As such, the resulting electroformed filter structure has a uniform pore size, which in this instance is a uniform pore diameter.

It is to be understood that the metalized structure should have sufficient rigidity such that the filter 6 can withstand the pressure drop associated with fluid passage through the filter 6. The ability of the metalized structure to withstand the pressure drop is related to the first and second recess edge-to-edge spacing 52, 72 and to the thickness of the metalized structure. As discussed above, the metalized structure should include pluralities of first and second photoresist pegs 10, 20 of the mandrel 5 that have sufficient first and second edge-to-edge spacing 16, 26 as to form the filter 6 that is structurally sufficient.

Figure 4:
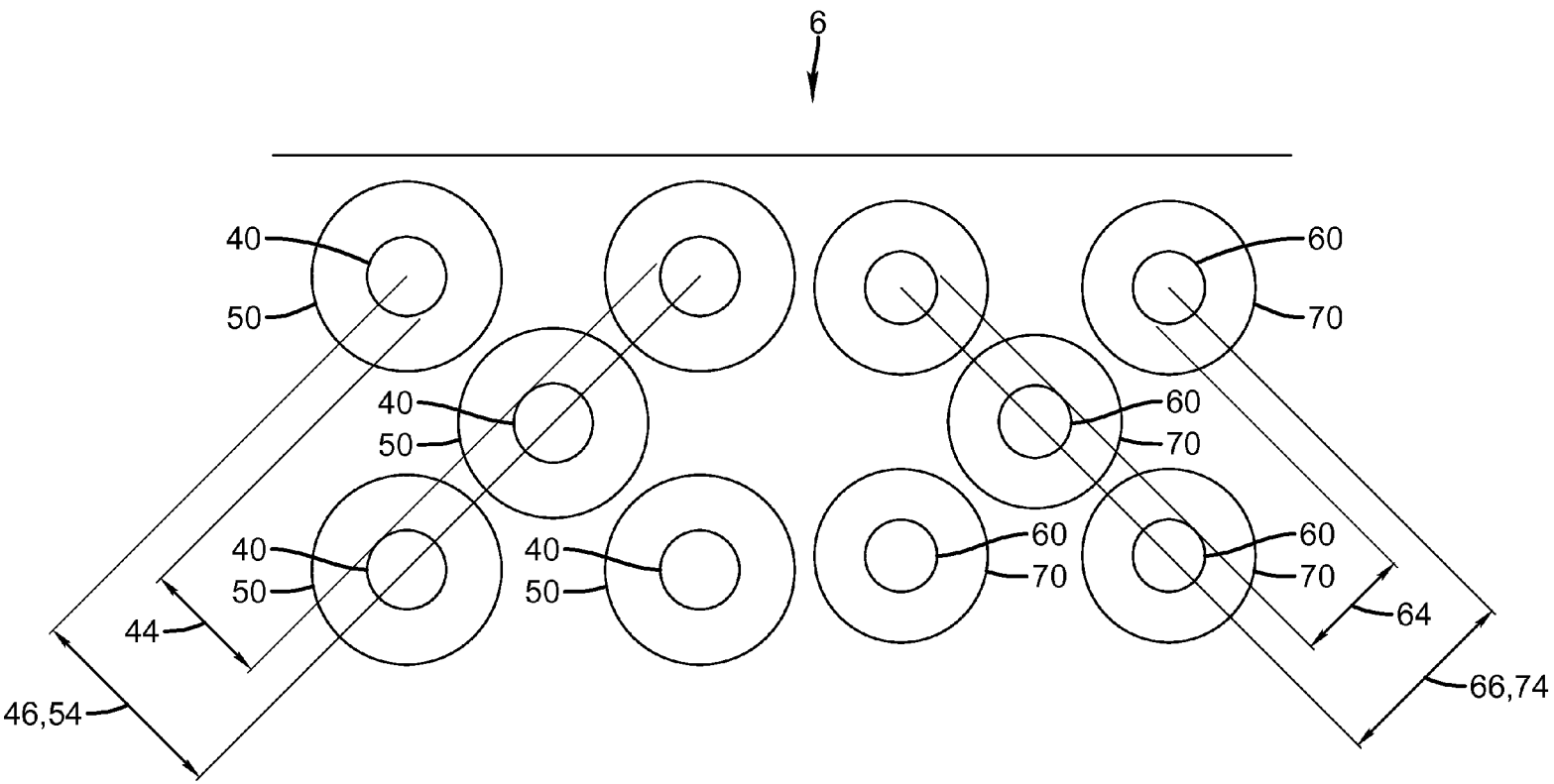
FIG. 4 is a plan view of a portion of an embodiment of a filter produced by the electroforming process showing the spatial relationship between the plurality of first and second recesses and the plurality of the first and second pores.

Referring to FIG. 4, a plan view of a portion of the filter 6 produced by the electroforming process is shown. FIG. 4 corresponds to viewing the filter from the bottom side of FIG. 3. Shown in particular, is the spatial relationship between the pluralities of first and second recesses 50, 70 and the pluralities of the first and second pores 40, 60. Each first recess 50 of the plurality of first recesses includes a corresponding first pore 40 of the plurality of first pores. Generally, the first recess center-to-center spacing 54 is approximately equivalent to the first pore center-to-center spacing 46. Similarly, the second recess center-to-center spacing 74 is approximately equivalent to the second pore center-to-center spacing 66. The result of the spatial relationships is that the first pore edge-to-edge spacing 44 is generally greater than the second pore edge-to-edge spacing 64.

The spatial relationship between the plurality of first and second recesses 50, 70 and the plurality of first and second pores 40, 60 provides for fluid communication. Liquid can pass through the filter 6 and any debris is prevented from passing through filter 6 if the debris is larger than the first and second pore diameters 42, 62.

Figure 5:
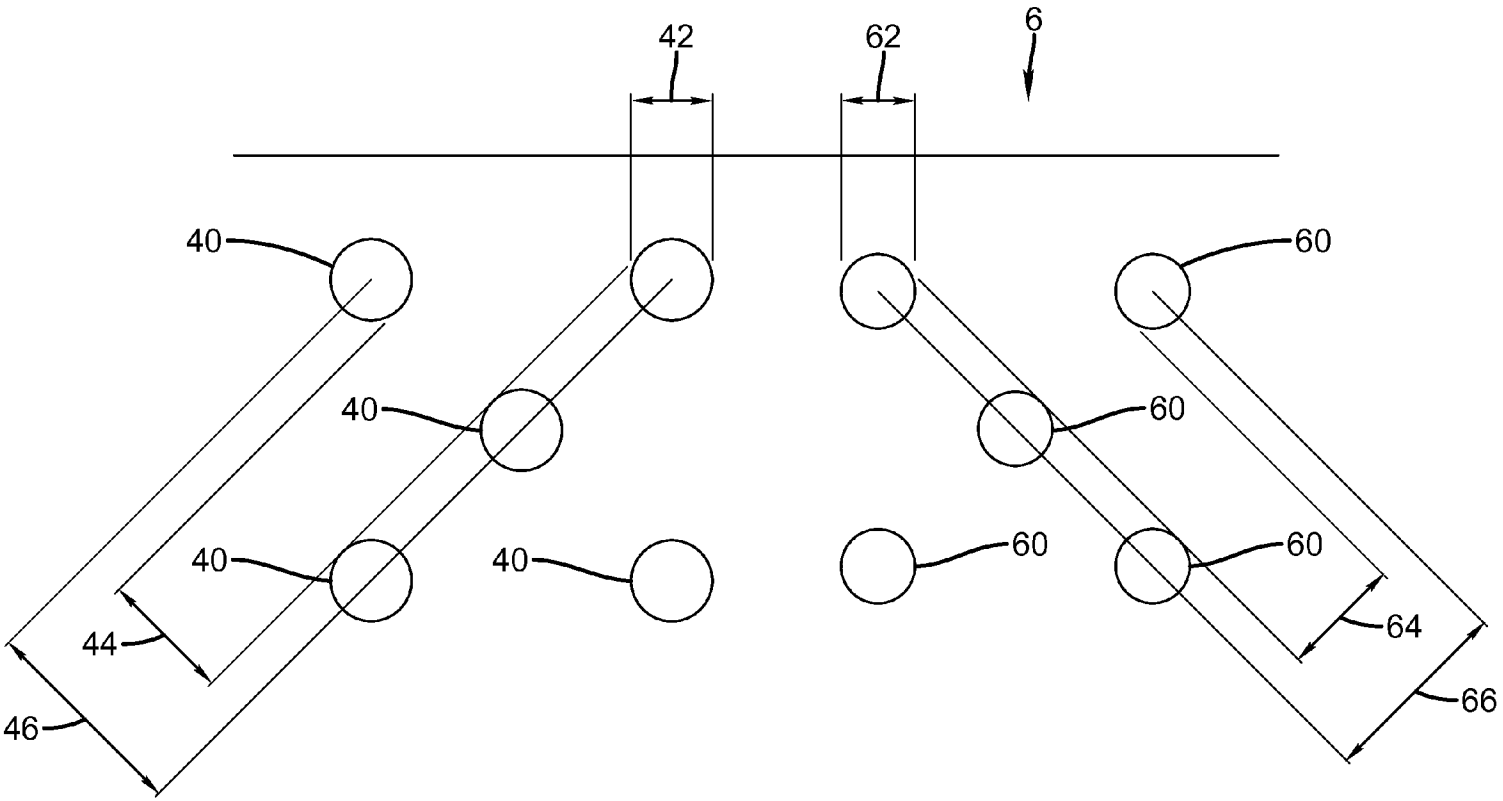
FIG. 5 is an another plan view of an embodiment of a filter produced by the electroforming process, showing the plurality of first and second pores.

FIG. 5 shows an alternative plan view of the filter 6 produced by the electroforming process. In this view, which corresponds to viewing the filter from the top side of FIG. 3, only the plurality of first and second pores 40, 60 are visible. The first pore diameter 42 of each of first pores 40 is approximately equivalent to the second pore diameter 62 of each of the second pores 60. However, due to the geometry of the plurality of first and second recesses 50, 70, the first pore edge-to-edge spacing 44 and the first pore center-to-center spacing 46 are generally greater than the second pore edge-to-edge spacing 64 and the second pore center-to-center spacing 66.

Figure 6:
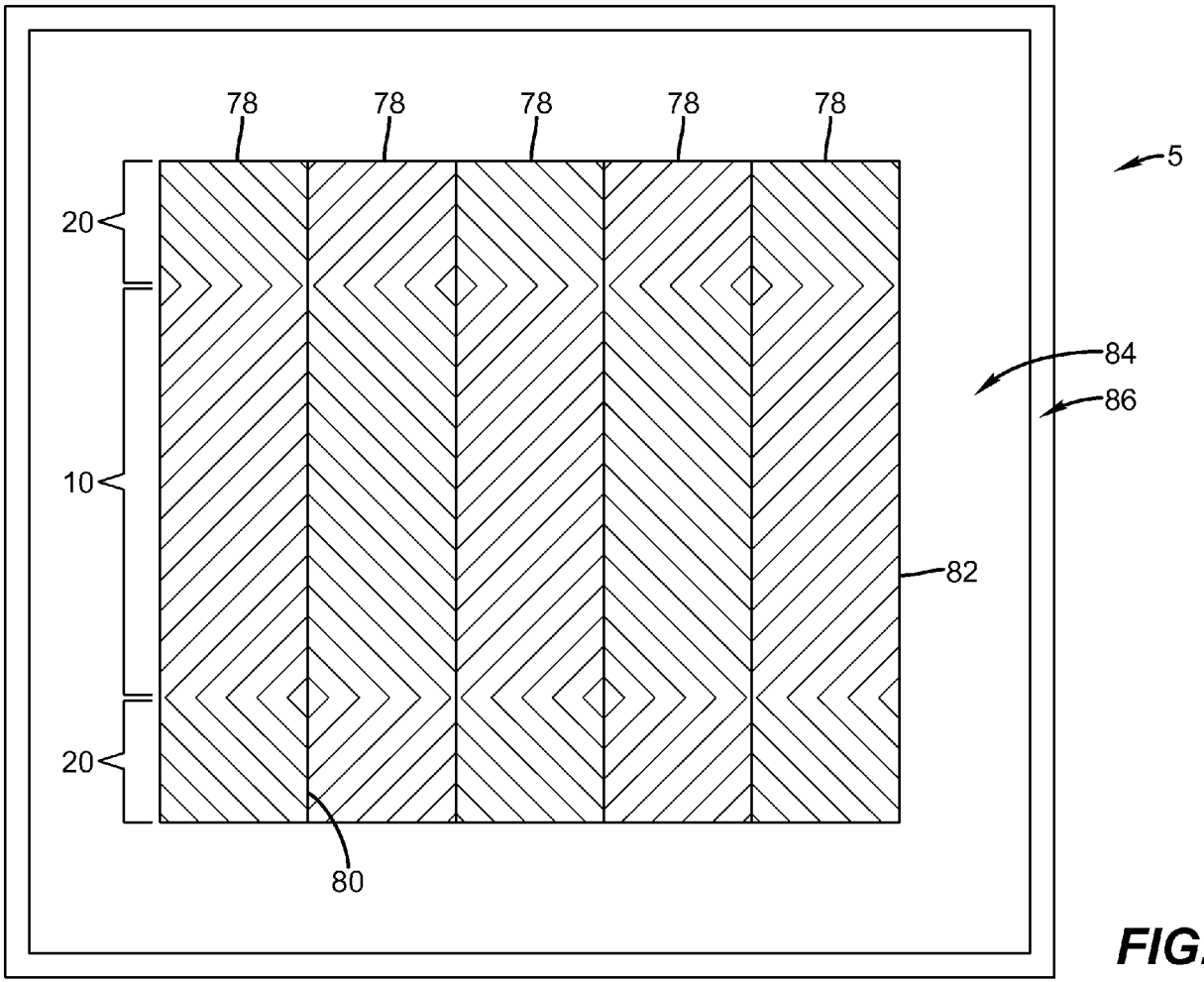
FIG. 6. is a plan view of the mandrel, on which multiple filters can be electroformed concurrently.

FIG. 6 is a plan view of the mandrel 5, upon which multiple filters 6 can be electroformed concurrently. The individual filter segments 78 of the mandrel 5 includes pluralities of first and second photoresist pegs 10, 20 which are surrounded by a photo resist border 82. Outside of the photoresist border is a margin 84, which is exposed conductive surface area in which source metal can plate, but also serves as a mounting region by which the mandrel is secured into a mandrel frame 86. To enhance the plating uniformity onto the filter segments of the mandrel, margin 84 also includes a plurality of photoresist pegs of a similar size and spacing as the second plurality of photoresist pegs 20. The margin 84 can also include features that can be monitored using a control system, for example, the real time control system described in U.S. Pat. No. 6,350,361, so that consistent pore sizes can be achieved from plating to the next. The mandrel frame 86 also includes electrical connectors not shown so that the mandrel 5 can be electrically connected as the cathode of the electroforming process. Within the photoresist border 82, there are photoresist barriers 80 that separate the individual filter segments 78.

Figure 7:
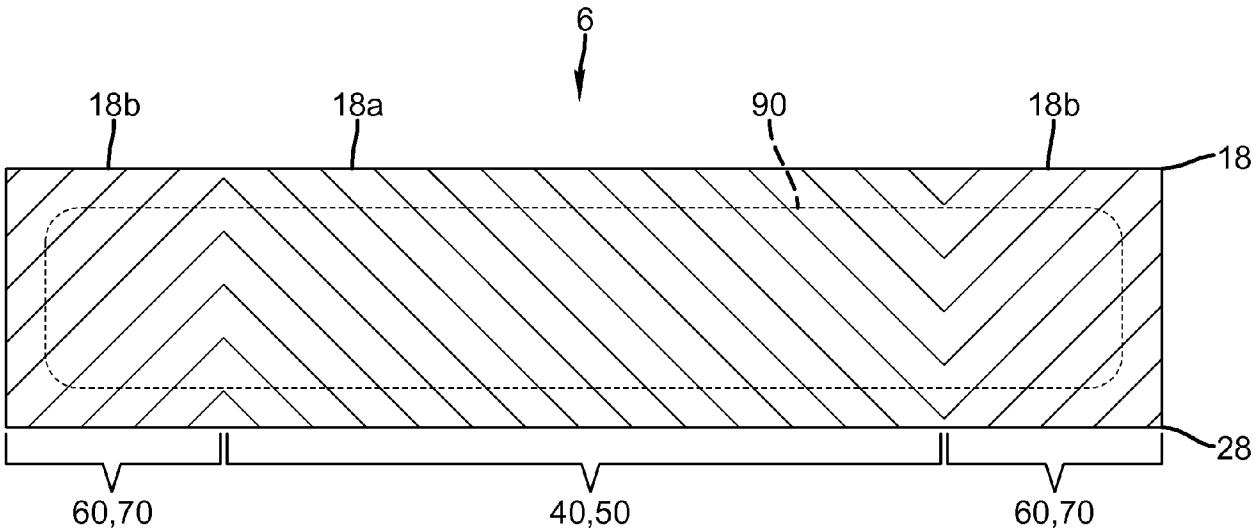
FIG. 7 is a plan view of the filter where the plurality of first pores and recesses comprise the middle portion and the plurality of second pores and recesses comprise the outer portions.

FIG. 7 shows a plan view of an embodiment of the filter 6 electroformed using the mandrel 5. When this filter 6 is used, the central portion of the filter 6, denoted by the region inside the dashed line 90, serves as the filtering region through which the fluid flows. The outer portion of the filter, outside the dashed line 90, serves as the mounting region of the filter by which the filter is mounted. The pluralities of first pores and recesses 40, 60 comprise the middle of the filter 6 and extend to a first portion 18A of a first side edge 18. The pluralities of second pores and recesses 50, 70 comprise the ends of the filter 6, and extend to a second portion 18B of the first side edge 18. The pluralities of first pores and recesses 40, 60 and the pluralities of second pores and recesses 50, 70 also extend to a second edge 28, respectively. The pores and recesses are present not only in the filtering region, but also in the mounting region. The inclusion of the pores and recesses in the mounting region helps to improve the pore size uniformity in the filtering region of the filter. This also facilitates installation of the filter 6, which is typically held in place by adhesive, because the recesses and pores provide additional surface area for the adhesive to adhere.

It is also contemplated that the mandrel 5 include a plurality of third photoresist pegs in order to provide for further refinement with regard to compensating for the non-uniform current density. The plurality of third pegs includes a third diameter that is generally smaller the second diameter 22. A third edge-to-edge spacing is approximately equivalent to the first and second edge-to-edge spacing 16, 26.

The resulting filter 6, includes a plurality of third pores, a plurality of third recesses, each of the plurality of third recesses having a third recess diameter, the plurality of third recesses having a third recess center spacing relative to each other. The filter 6 also includes a plurality of third pores, each of the plurality of third pores being in fluid communication with a corresponding one of the plurality of third recesses. The third recess diameter is not equal to the first recess diameter 56 and is not equal to the second recess diameter 76. The third recess center spacing is not equal to the first recess center-to-center spacing 54 and is not equal to the second recess center-to-center spacing 74. Other example embodiments of the invention to include additional pluralities of recesses and pores with dimensions according to the pattern described above.

Example embodiments of a printing system and a method of printing that incorporate filter 6 are described below. Generally described, the printing systems include a filter, a printhead including a plurality of nozzles through which liquid is emitted, and a liquid supply system in liquid communication with the printhead through the filter. The filter is an electroformed metal structure and includes a plurality of first recesses, a plurality of second recesses, a plurality of first pores, and a plurality of second pores. Each of the plurality of first recesses includes a first recess diameter and a first recess center-to-center spacing relative to each other. Each of the plurality of second recesses includes a second recess diameter and a second recess center-to-center spacing relative to each other. Each of the plurality of first pores is in fluid communication with a corresponding one of the plurality of first recesses and each of the plurality of second pores is in fluid communication with a corresponding one of the plurality of second recesses. In the filter, the first recess diameter is not equal to the second recess diameter and the first recess center-to-center spacing is not equal to the second recess center-to-center spacing.

In one example embodiment of a printing system that includes the filter described above, the liquid supply system includes a pressurized liquid source so that liquid is continuously ejected through the plurality of nozzles of the printhead. In another example embodiment in which the liquid supply system includes a pressurized liquid source, liquid is continuous circuited through the liquid supply system but is only ejected through the plurality of nozzles of the printhead when printing liquid drops are desired. Alternatively, the liquid is continuous circuited through the liquid supply system and the printhead. In another example embodiment, liquid is only ejected through the plurality of nozzles of the printhead when printing liquid drops are desired. In this embodiment, the liquid supply does not include a pressurized liquid supply like the embodiments described above.

Each of the plurality of nozzles of the printhead has a diameter. The diameter of the plurality of first pores and the diameter of the plurality of second pores of the filter is less than the diameter of the plurality of nozzles. Preferably, the diameter of the plurality of first pores and the diameter of the plurality of second pores is less than or equal to one half of the diameter of the plurality of nozzles.

In operation, liquid is caused to be emitted through the plurality of nozzles of the printhead after the filter, the printhead including a plurality of nozzles through which liquid is emitted, and the liquid supply system in liquid communication with the printhead through the filter have been provided.

The flowing of liquid through the printing system is accomplished in one of several ways. For example, when the liquid supply system includes a pressurized liquid source liquid, liquid is emitted through the plurality of nozzles of the printhead by continuously ejecting liquid through the plurality of nozzles of the printhead using the pressurized liquid source. Alternatively, the liquid is continuously circulated through the liquid supply system using the pressurized liquid source but ejected through the plurality of nozzles of the printhead only when printing liquid drops are desired. In this type of printing system, the liquid can be continuously circulated liquid through the liquid supply system and the printhead. In another example embodiment of printing system operation, liquid is emitted through the plurality of nozzles of the printhead by causing the liquid to be ejected through the plurality of nozzles of the printhead only when printing liquid drops are desired.

Figure 8:
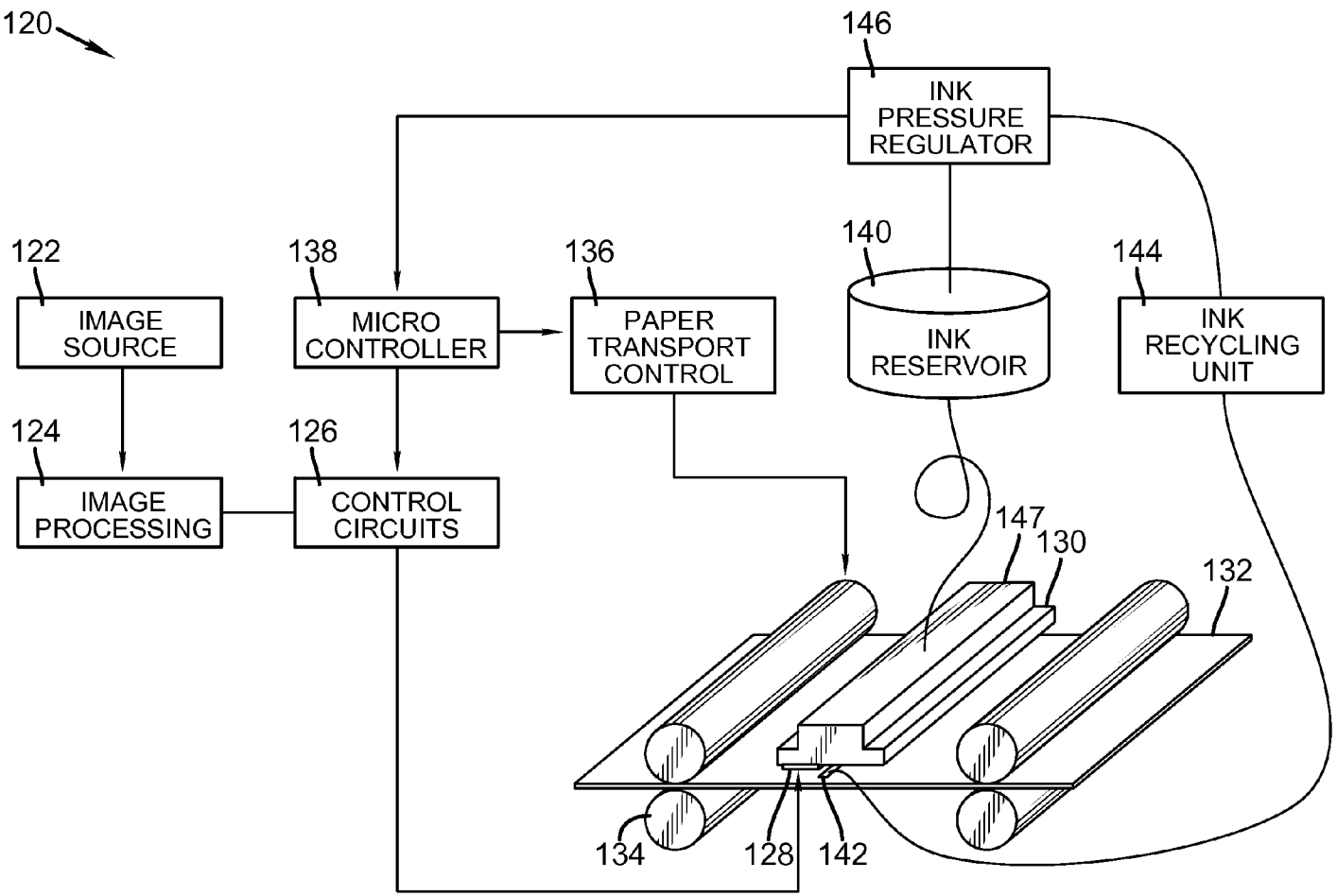
FIG. 8 is a simplified schematic block diagram of an example embodiment of a printing system made in accordance with the present invention.

Referring to FIG. 8, a continuous printing system 120 includes an image source 122 such as a scanner or computer which provides raster image data, outline image data in the form of a page description language, or other forms of digital image data. This image data is converted to half-toned bitmap image data by an image processing unit 124 which also stores the image data in memory. A plurality of drop forming mechanism control circuits 126 read data from the image memory and apply time-varying electrical pulses to a drop forming mechanism(s) 128 that are associated with one or more nozzles of a printhead 130. These pulses are applied at an appropriate time, and to the appropriate nozzle, so that drops formed from a continuous ink jet stream will form spots on a recording medium 132 in the appropriate position designated by the data in the image memory.

Recording medium 132 is moved relative to printhead 130 by a recording medium transport system 134, which is electronically controlled by a recording medium transport control system 136, and which in turn is controlled by a microcontroller 138. The recording medium transport system shown in FIG. 8 is a schematic only, and many different mechanical configurations are possible. For example, a transfer roller could be used as recording medium transport system 134 to facilitate transfer of the ink drops to recording medium 132. Such transfer roller technology is well known in the art. In the case of page width printheads, it is most convenient to move recording medium 132 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 140 under pressure. In the non-printing state, continuous ink jet drop streams are unable to reach recording medium 132 due to an ink catcher 142 that blocks the stream and which may allow a portion of the ink to be recycled by an ink recycling unit 144. The ink recycling unit reconditions the ink and feeds it back to reservoir 140. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 140 under the control of ink pressure regulator 146. Alternatively, the ink reservoir can be left unpressurized, or even under a reduced pressure (vacuum), and a pump is employed to deliver ink from the ink reservoir under pressure to the printhead 130. When this is done, the ink pressure regulator 146 can include an ink pump control system. As shown in FIG. 8, catcher 142 is a type of catcher commonly referred to as a "knife edge" catcher.

The ink is distributed to printhead 130 through an ink channel 147. The ink preferably flows through slots or holes etched through a silicon substrate of printhead 130 to its front surface, where a plurality of nozzles and drop forming mechanisms, for example, heaters, are situated. When printhead 130 is fabricated from silicon, drop forming mechanism control circuits 126 can be integrated with the printhead. Printhead 130 also includes a deflection mechanism (not shown in FIG. 8) which is described in more detail below with reference to FIGS. 9 and 10.

Figure 9:
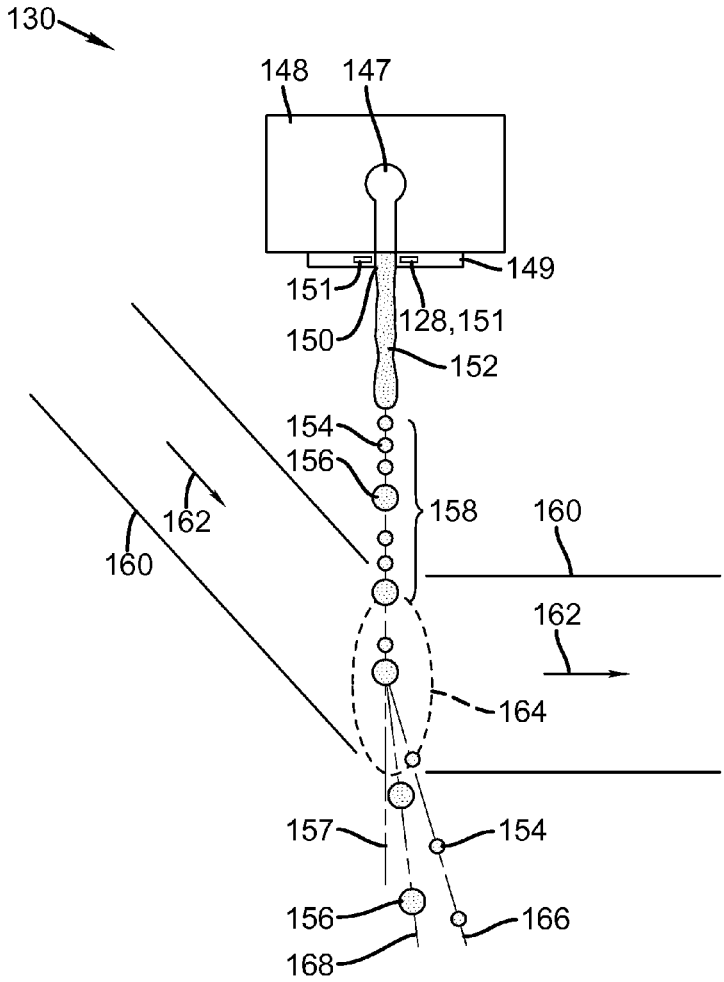
FIG. 9 is a schematic view of an example embodiment of a continuous printhead made in accordance with the present invention.
Figure 10:
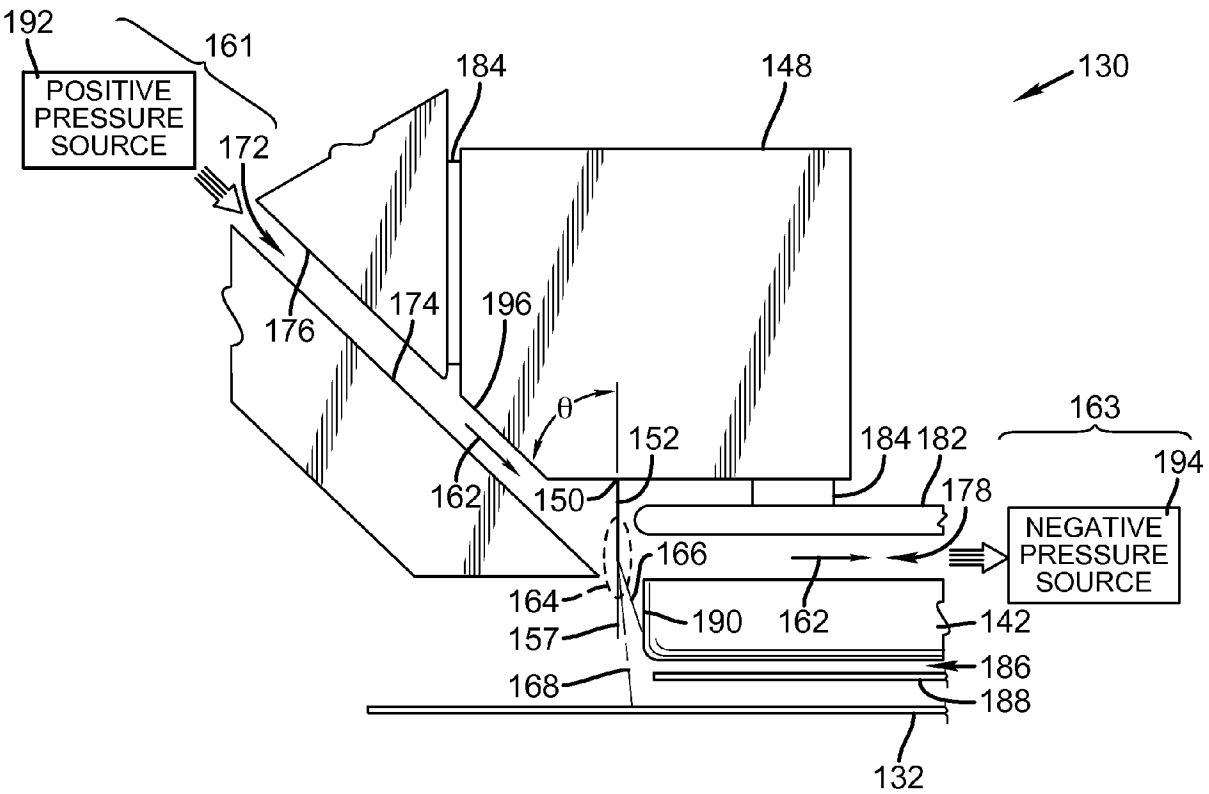
FIG. 10 is a schematic view of an example embodiment of a continuous printhead made in accordance with the present invention.

Referring to FIG. 9, a schematic view of continuous liquid printhead 130 is shown. A jetting module 148 of printhead 130 includes an array or a plurality of nozzles 150 formed in a nozzle plate 149. In FIG. 9, nozzle plate 149 is affixed to jetting module 148. However, as shown in FIG. 10, nozzle plate 149 can be an integral portion of the jetting module 148. Liquid, for example, ink, is emitted under pressure through each nozzle 150 of the array to form filaments of liquid 152. In FIG. 9, the array or plurality of nozzles extends into and out of the figure.

Jetting module 148 is operable to form liquid drops having a first size or volume and liquid drops having a second size or volume through each nozzle. To accomplish this, jetting module 148 includes a drop stimulation or drop forming device 128, for example, a heater or a piezoelectric actuator, that, when selectively activated, perturbs each filament of liquid 152, for example, ink, to induce portions of each filament to breakoff from the filament and coalesce to form drops 154, 156.

In FIG. 9, drop forming device 128 is a heater 151, for example, an asymmetric heater or a ring heater (either segmented or not segmented), located in a nozzle plate 149 on one or both sides of nozzle 150. This type of drop formation is known and has been described in one or more of U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005.

Typically, one drop forming device 128 is associated with each nozzle 150 of the nozzle array. However, a drop forming device 128 can be associated with groups of nozzles 150 or all of nozzles 150 of the nozzle array.

When printhead 130 is in operation, drops 154, 156 are typically created in a plurality of sizes or volumes, for example, in the form of large drops 156, a first size or volume, and small drops 154, a second size or volume. The ratio of the mass of the large drops 156 to the mass of the small drops 154 is typically approximately an integer between 2 and 10. A drop stream 158 including drops 154, 156 follows a drop path or trajectory 157.

Printhead 130 also includes a gas flow deflection mechanism 160 that directs a flow of gas 162, for example, air, past a portion of the drop trajectory 157. This portion of the drop trajectory is called the deflection zone 164. As the flow of gas 162 interacts with drops 154, 156 in deflection zone 164 it alters the drop trajectories. As the drop trajectories pass out of the deflection zone 164 they are traveling at an angle, called a deflection angle, relative to the undeflected drop trajectory 157.

Small drops 154 are more affected by the flow of gas than are large drops 156 so that the small drop trajectory 166 diverges from the large drop trajectory 168. That is, the deflection angle for small drops 154 is larger than for large drops 156. The flow of gas 162 provides sufficient drop deflection and therefore sufficient divergence of the small and large drop trajectories so that catcher 142 (shown in FIGS. 8 and 10) can be positioned to intercept one of the small drop trajectory 166 and the large drop trajectory 168 so that drops following the trajectory are collected by catcher 142 while drops following the other trajectory bypass the catcher and impinge a recording medium 132 (shown in FIGS. 8 and 10).

When catcher 142 is positioned to intercept large drop trajectory 168, small drops 154 are deflected sufficiently to avoid contact with catcher 142 and strike the print media. As the small drops are printed, this is called small drop print mode. When catcher 142 is positioned to intercept small drop trajectory 166, large drops 156 are the drops that print. This is referred to as large drop print mode.

Referring to FIG. 10, jetting module 148 includes an array or a plurality of nozzles 150. Liquid, for example, ink, supplied through channel 147, is emitted under pressure through each nozzle 150 of the array to form filaments of liquid 152. In FIG. 3, the array or plurality of nozzles 150 extends into and out of the figure.

Drop stimulation or drop forming device 128 (shown in FIGS. 8 and 9) associated with jetting module 148 is selectively actuated to perturb the filament of liquid 152 to induce portions of the filament to break off from the filament to form drops. In this way, drops are selectively created in the form of large drops and small drops that travel toward a recording medium 132.

Positive pressure gas flow structure 161 of gas flow deflection mechanism 160 is located on a first side of drop trajectory 157. Positive pressure gas flow structure 161 includes first gas flow duct 172 that includes a lower wall 174 and an upper wall 176. Gas flow duct 172 directs gas flow 162 supplied from a positive pressure source 192 at downward angle θ of approximately a 45° relative to liquid filament 152 toward drop deflection zone 164 (also shown in FIG. 9). An optional seal(s) 184 provides an air seal between jetting module 148 and upper wall 176 of gas flow duct 172.

Upper wall 176 of gas flow duct 172 does not need to extend to drop deflection zone 164 (as shown in FIG. 9). In FIG. 10, upper wall 176 ends at a wall 196 of jetting module 148. Wall 196 of jetting module 148 serves as a portion of upper wall 176 ending at drop deflection zone 164.

Negative pressure gas flow structure 163 of gas flow deflection mechanism 160 is located on a second side of drop trajectory 157. Negative pressure gas flow structure includes a second gas flow duct 178 located between catcher 142 and an upper wall 182 that exhausts gas flow from deflection zone 164. Second duct 178 is connected to a negative pressure source 194 that is used to help remove gas flowing through second duct 178. An optional seal(s) 184 provides an air seal between jetting module 148 and upper wall 182.

As shown in FIG. 10, gas flow deflection mechanism 160 includes positive pressure source 192 and negative pressure source 194. However, depending on the specific application contemplated, gas flow deflection mechanism 160 can include only one of positive pressure source 192 and negative pressure source 194.

Gas supplied by first gas flow duct 172 is directed into the drop deflection zone 164, where it causes large drops 156 to follow large drop trajectory 168 and small drops 154 to follow small drop trajectory 166. As shown in FIG. 10, small drop trajectory 166 is intercepted by a front face 190 of catcher 142. Small drops 154 contact face 190 and flow down face 190 and into a liquid return duct 186 located or formed between catcher 142 and a plate 188. Collected liquid is either recycled and returned to ink reservoir 140 (shown in FIG. 8) for reuse or discarded. Large drops 156 bypass catcher 142 and travel on to recording medium 132. Alternatively, catcher 142 can be positioned to intercept large drop trajectory 168. Large drops 156 contact catcher 142 and flow into a liquid return duct located or formed in catcher 142. Collected liquid is either recycled for reuse or discarded. Small drops 154 bypass catcher 142 and travel on to recording medium 132.

Alternatively, deflection can be accomplished by applying heat asymmetrically to filament of liquid 152 using an asymmetric heater 151. When used in this capacity, asymmetric heater 151 typically operates as the drop forming mechanism in addition to the deflection mechanism. This type of drop formation and deflection is known having been described in, for example, U.S. Pat. No. 6,079,821, issued to Chwalek et al., on Jun. 27, 2000.

Deflection can also be accomplished using an electrostatic deflection mechanism. Typically, the electrostatic deflection mechanism either incorporates drop charging and drop deflection in a single electrode, like the one described in U.S. Pat. No. 4,636,808, issued to Herron, on Jan. 13, 1987, or includes separate drop charging and drop deflection electrodes.

As shown in FIG. 10, catcher 142 is a type of catcher commonly referred to as a "Coanda" catcher. However, the "knife edge" catcher shown in FIG. 8 and the "Coanda" catcher shown in FIG. 10 are interchangeable and either can be used usually the selection depending on the application contemplated. Alternatively, catcher 142 can be of any suitable design including, but not limited to, a porous face catcher, a delimited edge catcher, or combinations of any of those described above.

In printing system 120, filter 6 is located in channel 147 of jetting module 148. Filter 6, however, can be located in other areas of printing system 120 including for example, in reservoir 140 or along the liquid supply path that connects reservoir 140 to jetting module 148 in liquid communication, or in a combination of these locations (including jetting module 148).

It is contemplated that the present invention also finds application in other types of printing systems, printheads, or jetting modules including, for example, drop on demand devices and flow through liquid dispensers. For example, filter 6 can be included in the flow through (or continuous on demand) printing systems or printheads described in US Patent Application Publication No. US 2007/0291082 A1, published on Dec. 20, 2007 (the entire disclosure of which is incorporated by reference herein); US Patent Application Publication No. US 2009/0135223 A1, published on May 28, 2009 (the entire disclosure of which is incorporated by reference herein); US Patent Application Publication No. US 2009/0195612 A1, published on Aug. 6, 2009 (the entire disclosure of which is incorporated by reference herein); or US Patent Application Publication No. US 2010/0328407 A1, published on Dec. 30, 2010 (the entire disclosure of which is incorporated by reference herein). When this is done, filter 6 is located in the liquid supply, along the liquid flow path, in the printhead, or in a combination of these locations depending on the specific application contemplated. When filter 6 is located in the printhead, filter 6 is positioned upstream relative to the outlet opening (or nozzle) of the printhead as viewed in a direction of liquid travel. Alternatively, filter 6 can be located downstream relative to the outlet opening (or nozzle) of the printhead as viewed in a direction of liquid travel to minimize pressure changes associated with actuation of a diverter member and a portion of liquid being deflected toward the outlet opening.

Alternatively, filter 6 can be included in a conventional drop on demand printing system or printhead. When this is done, filter 6 is located in the liquid supply, along the liquid flow path, in the printhead, or in a combination of these locations depending on the specific application contemplated.

As described above, the example embodiments of the present invention include a printing system, a printhead or a method of printing typically used in inkjet printing systems. However, many other applications are emerging which use inkjet printheads to emit liquids (other than inks) that need to be finely metered and deposited with high spatial precision. As such, the terms "liquid" and "ink" refer to any material that can be ejected by these printing systems, printheads, or using the printing techniques described above.

The invention has been described in detail with particular reference to certain preferred embodiments thereof, but it will be understood that variations and modifications can be effected within the scope of the invention. For example, while the example embodiments of the invention described above generally refer to a filter, it is contemplated that the present invention is applicable to any electroformed metal structure that requires geometric features of uniform size and shape.

PARTS LIST

5 Electroform Mandrel
6 Filter
7 Conductive Layer
8 Photoresist Peg
10 First Photoresist Pegs
12 First Diameter
14 First Center-to-Center Spacing
16 First Edge-to-Edge Spacing
18 Side Edge
18*a* First Portion
18*b* Second Portion
20 Second Photoresist Pegs
22 Second Diameter
24 Second Center-to-Center Spacing
26 Second Edge-to-Edge Spacing
28 Second Side Edge
29 Metalized Edge
30 Initial Plating Thickness
32 Intermediate Plating Thickness
34 Final Plating Thickness
36 Openings
38 Metalized Layer
40 First Pores
42 First Pore Diameter
44 First Pore Edge-to-Edge Spacing
46 First Pore Center Spacing
50 First Recesses
52 First Recess Edge-to-Edge Spacing
54 First Recess Center Spacing
56 First Recess Diameter
60 Second Pores
62 Second Pore Diameter
64 Second Pore Edge-to-Edge Spacing
66 Second Pore Center-to-Center Spacing
70 Second Recesses
72 Second Recess Edge-to-Edge Spacing
74 Second Recess Center-to-Center Spacing
76 Second Recess Diameter
78 Filter Segment
80 Photoresist Barrier
82 Photoresist Border
84 Margin
86 Mandrel Frame
90 Filtering Area Border
120 continuous printer system
122 image source
124 image processing unit
126 mechanism control circuits
128 device
130 printhead
132 recording medium
134 recording medium transport system
136 recording medium transport control system
138 micro-controller
140 reservoir
142 catcher
144 recycling unit
146 pressure regulator
147 channel
148 jetting module
149 nozzle plate
150 plurality of nozzles
151 heater
152 liquid
154 drops
156 drops
157 trajectory
158 drop stream
160 gas flow deflection mechanism
161 positive pressure gas flow structure
162 gas flow
163 negative pressure gas flow structure
164 deflection zone
166 small drop trajectory
168 large drop trajectory
172 first gas flow duct
174 lower wall
176 upper wall
178 second gas flow duct
182 upper wall
186 liquid return duct
188 plate
190 front face
192 positive pressure source
194 negative pressure source
196 wall

The invention claimed is:

1. A printing system comprising:

a filter including:

an electroformed metal structure including:

a plurality of first recesses, each of the plurality of first recesses having a first recess diameter, the plurality of first recesses having a first recess center-to-center spacing relative to each other;

a plurality of second recesses, each of the plurality of second recesses having a second recess diameter, the plurality of second recesses having a second recess center-to-center spacing relative to each other;

a plurality of first pores, each of the plurality of first pores being in fluid communication with a corresponding one of the plurality of first recesses; and a plurality of second pores, each of the plurality of second pores being in fluid communication with a corresponding one of the plurality of second recesses, wherein the first recess diameter is not equal to the second recess diameter, and the first recess center-to-center spacing is not equal to the second recess center-to-center spacing;

a printhead including a plurality of nozzles through which liquid is emitted; and a liquid supply system in liquid communication with the printhead through the filter.

2. The system of claim 1, the liquid supply system including a pressurized liquid source, wherein liquid is continuously ejected through the plurality of nozzles of the printhead.

3. The system of claim 1, wherein liquid is only ejected through the plurality of nozzles of the printhead when printing liquid drops are desired.

4. The system of claim 1, the liquid supply system including a pressurized liquid source, wherein liquid is continuous circuited through the liquid supply system but is only ejected through the plurality of nozzles of the printhead when printing liquid drops are desired.

5. The system of claim 4, wherein liquid is continuous circuited through the liquid supply system and the printhead.

6. The system of claim 1, each of the plurality of nozzles having a diameter, wherein the diameter of the plurality of first pores and the diameter of the plurality of second pores is less than the diameter of the plurality of nozzles.

7. The system of claim 6, wherein the diameter of the plurality of first pores and the diameter of the plurality of second pores is less than or equal to one half of the diameter of the plurality of nozzles.

8. A method of printing comprising:

providing a filter including:

an electroformed metal structure including:

a plurality of first recesses, each of the plurality of first recesses having a first recess diameter, the plurality of first recesses having a first recess center-to-center spacing relative to each other;

a plurality of second recesses, each of the plurality of second recesses having a second recess diameter, the plurality of second recesses having a second recess center-to-center spacing relative to each other;

a plurality of first pores, each of the plurality of first pores being in fluid communication with a corresponding one of the plurality of first recesses; and a plurality of second pores, each of the plurality of second pores being in fluid communication with a corresponding one of the plurality of second recesses, wherein the first recess diameter is not equal to the second recess diameter, and the first recess center-to-center spacing is not equal to the second recess center-to-center spacing;

providing a printhead including a plurality of nozzles through which liquid is emitted;

providing a liquid supply system in liquid communication with the printhead through the filter; and causing liquid to be emitted through the plurality of nozzles of the printhead.

9. The method of claim 8, the liquid supply system including a pressurized liquid source, wherein causing liquid to be emitted through the plurality of nozzles of the printhead includes continuously ejecting liquid through the plurality of nozzles of the printhead using the pressurized liquid source.

10. The method of claim 8, wherein causing liquid to be emitted through the plurality of nozzles of the printhead includes causing liquid to be ejected through the plurality of nozzles of the printhead only when printing liquid drops are desired.

11. The method of claim 8, the liquid supply system including a pressurized liquid source, wherein causing liquid to be emitted through the plurality of nozzles of the printhead includes continuously circulating liquid through the liquid supply system using the pressurized liquid source but ejecting liquid through the plurality of nozzles of the printhead only when printing liquid drops are desired.

12. The system of claim 11, wherein continuously circulating liquid through the liquid supply system using the pressurized liquid source includes continuously circulating liquid through the liquid supply system and the printhead.

13. The method of claim 8, each of the plurality of nozzles having a diameter, wherein the diameter of the plurality of first pores and the diameter of the plurality of second pores is less than the diameter of the plurality of nozzles.

14. The method of claim 13, wherein the diameter of the plurality of first pores and the diameter of the plurality of second pores is less than or equal to one half of the diameter of the plurality of nozzles.

* * * * *